United States Patent [19]

Blanc

[11] 3,949,473

[45] Apr. 13, 1976

[54] BOLT CUTTER

[75] Inventor: Michel Blanc, Saint Etienne, France

[73] Assignee: Forges Stephanoises, Saint-Etienne, France

[22] Filed: Feb. 14, 1975

[21] Appl. No.: 550,022

[30] Foreign Application Priority Data

Feb. 18, 1974 France ..... 74.06037

[52] U.S. Cl. ..... 30/191

[51] Int. Cl.[2] ..... B26B 17/02

[58] Field of Search ..... 30/191, 192, 252, 193, 30/190, 349

[56] References Cited

UNITED STATES PATENTS

| | | | |
|---|---|---|---|
| 102,006 | 4/1870 | Howard | 30/191 |
| 188,133 | 3/1877 | Hellwig | 30/191 |
| 227,684 | 5/1880 | Gee | 30/191 |

*Primary Examiner*—Al Lawrence Smith
*Assistant Examiner*—J. C. Peters
*Attorney, Agent, or Firm*—Karl F. Ross; Herbert Dubno

[57] ABSTRACT

A bolt cutter has a pair of plates between which pass a pair of front axle pins on which are pivoted a pair of blades and a pair of rear axle pins fixed relative to the front pins and in turn pivotally carrying a pair of handles. The rear end section of each blade is formed with a part-cylindrical seat receiving the cylindrical head on one end of a rigid link having on its opposite end another such cylindrical head received in another part-cylindrical seat formed in the front end section of the respective handle. The parts of the blades and handles as well as the links between the support plates are all of like thickness and snugly held between these plates. A pair of inwardly open part-cylindrical seats formed in the blades between the front pins receive a pin serving to ensure symmetrical movement of the two blades whose cutting portions are spaced apart even when the blades are closed.

5 Claims, 8 Drawing Figures

Fa
Fr
A
B
b
a
e

Fa1
Fr1
A1
B1
e

Fh
Fm
D
C
b1
a1
e

Fh1
Fm1
C1
D1
b2
e

BOLT CUTTER

FIELD OF THE INVENTION

My present invention relates to a tool for cutting bolts, rod stock, cables, and the like. More particularly this invention concerns a manually operated, plier-type cutter.

BACKGROUND OF THE INVENTION

Various plier-type tools are known, such as bolt cutters, wire strippers, sheet-metal benders, nut crackers, punches, and the like, which have a pair of handles that are displaced toward each other in order to move a pair of grippers, blades, or the like together on the workpiece in question. A mechanical advantage is often gained by forming the blades separately from the handles and providing a linkage between these handles and the blades so as to multiply the force exerted by the user on the handles. Such provision is particularly necessary in devices for cutting bolts, reinforcing rods, and the like where the mechanical resistance of the workpiece may require a force of at least 140 hectobars for penetrating the workpiece with the blades.

The most common type of bolt cutter has a so-called knee linkage for multiplying the force exerted on the arms or handles. In this arrangement each handle has its forward end pivoted only on the forward end of the other handle, and each blade is pivoted on each handle at a location somewhat behind this common pivot. Otherwise the two blades are pivoted on a support plate for swinging either about respective axes or on another common axis.

In such a system it is necessary to provide a relatively complicated arrangement to ensure symmetry of movement of the two blades. Furthermore the mechanical requirements of the structure require that the the two blades and handles be different from each other, thereby increasing cost of production and complicating repair.

Another great disadvantage of the known cutters is that the force-multiplication arrangement operates kinematically so that the pressure exerted by the blades on the workpiece is in inverse proportion to the distance between the outer ends of the handle arms. It has been discovered, however, that the force with which the average workpiece resists penetration of the blades usually increases at a greater rate, so that after a predetermined depth of penetration the force that can be comfortably exerted by the user is insufficient to overcome the material hardness. Only when another, higher limit is passed does penetration commence again, usually simultaneously with a complete cutting through of the workpiece. Of course in reality neither of these characteristics can be represented as a straight-line graph.

Thus it is necessary with the prior-art cutters of the above-described type that the force exerted by the operator increases considerably during a portion of the cutting operation. This increase is usually called for at a time when kinematically it is very inconvenient for the operator, because of position of the handles, to augment the force he is applying. To this end recourse is frequently had to twisting the cutter once the blades have penetrated to an extent corresponding to that penetration beyond which a greatly augmented force will be necessary for further cutting. This twisting causes the parts of the cutter to work loose and quickly dulls the blade or blades, depending on whether two cutting blades are provided or just one cutting blade and an anvil blade.

OBJECTS OF THE INVENTION

It is therefore an object of the present invention to provide an improved tool for cutting, holding, squeezing, and like operations.

Another object is the provision of an improved bolt cutter.

A further object of my invention is to provide such a tool which can be made very inexpensively, and with identical blades and handles.

Yet another object is the provision of a cutting tool having improved kinematics so that cutting of relatively hard workpieces, such as bolts or reinforcing bars of steel, can be effected with relative ease.

SUMMARY OF THE INVENTION

These objects are attained according to the present invention in a tool for cutting, holding, or squeezing which comprises a support plate provided with a pair of front axle pins, and with a pair of rear axle pins rearward of and parallel to the front pins. A pair of blades, both of which may have cutting edges or one of which may be formed as an anvil, are provided with each blade pivoted on a respective front axle pin and having rearwardly of the respective pin a respective rear extremity. a pair of handles are pivoted on the support on a respective rear axle pin and each having a front extremity forwardly of the respective rear axle pin and between the rear sections of the blades. A rigid link is pivoted at one end on a respective front handle extremity and at its opposite end on the respective rear extremity of the respective blade. Thus as the back ends of the handles are brought together their front extremities separate and push the rear extremities of the blades apart, thereby bringing the frontal cutting portions of these blades together.

Thanks to the pivoting of the handles on the same plate as the blades the relationship between the force exerted on the outer ends of these handles and the force exerted by the cutting portions of the blades on the workpiece allows the force with which the workpiece resists penetration of these blades to be overcome easily. Thus it is possible with the tool according to this invention readily to cut through even the most stubborn workpieces.

According to yet another feature of the invention the two handles and the two blades are respectively identical. This is made possible by providing a pair of identical support plates which flank the rear extremities of the blades, the links, and the front extremities of the handles, all of which are of like thickness.

In order to facilitate symmetrical displacement of the blades with respect to a longitudinal midplane parallel to the axle pins and equispaced therebetween, I prefer to provide a short pin seated in a pair of concave recesses formed in the blades directly between the front axle pins and together forming a cylindrical socket for the pin.

The links, according to a further feature of my instant invention, are substantially dumbbell-shaped thrust rods or pitmans with generally cylindrical heads at their ends. The rear extremities of the blades and the front extremities of the handles are formed with correspondingly part-cylindrical seats swivelably engaging these heads. The seats snugly receive the heads and define arcs of more than 180° so as to prevent the heads from slipping out. The links, or for that matter any of the parts of the cutter, can readily be removed by taking off one of the support plates and pulling it out in line with the axes of the axle pins.

The cutting portions of the blades of my improved tool are sharp edges which are spaced from each other in the closed position of these blades. I have surprisingly found that it is not necessary for the cutting edges, or for a cutting edge and an anvil surface, to meet for complete cutting-through of a bolt, rod, or the like. This is due to the fact that the cutting operation relies less on shear than on squeezing or constriction to cut through the workpiece.

According to yet another feature of this invention the handles are formed in the region of their pivot pins with three-part camming surfaces. More particularly each handle is formed at its forward end with a central part-cylindrical surface centered on the respective pivot pin and adapted to roll off the complementary surface on the other handle during closing of the blades so as to absorb some of the force that would otherwise all be taken up by the rear axle pins. On either side of this central cylindrical surface there is provided a flat surface. One such flat surface is arranged to lie flatly against the corresponding surface of the other handle when the handles are spread to the maximum so as to prevent separation of these handles beyond a predetermined open position. The other surface has on the other side of the central surface and coacts with the corresponding surface of the other handle to prevent the handles from coming closer together than a predetermined closed position, so as to prevent damage to the blades and to prevent the user's knuckles from bumping together.

BRIEF DESCRIPTION OF THE DRAWING

The above and other objects, features, and advantages of my invention will become more readily apparent from the following detailed description, reference being made to the accompanying drawing in which.

SPECIFIC DESCRIPTION

Figure 1:
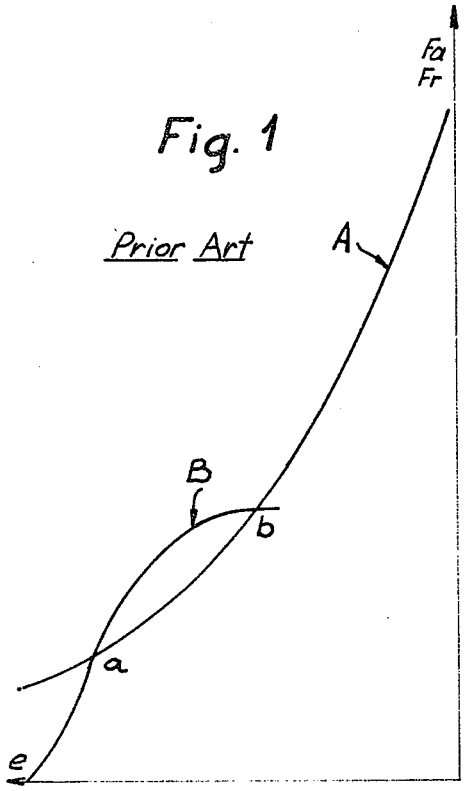
Fig. 1 Prior Art
FIGS. 1 and 2 are graphs illustrating the kinematics of a prior-art bolt cutter.

As shown in FIG. 1, in a prior-art cutter the curve A formed by plotting on the ordinate the force F*a* exertable by the blades on a workpiece with constant force applied at the outer ends of the handles and on the abscissa the distance *e* between these outer ends is generally upwardly concave. This curve A indicates that as the blades approach each other the force they can exert, with application of a given force to the outer handle ends, increases considerably. A curve B on FIG. 1 is a graph of the force Fr with which a workpiece resists penetration of the blades as the distance *e* between the handles, and therefore between the blades, decreases. It can be seen that this curve cuts across the curve A at a point *a*, when the blade or blades have penetrated a limited distance into the workpiece, but can only cross through the curve A again at *b*, assuming that the handle spacing *e* has somehow been decreased. This point *b* corresponds to the instant when the workpiece is sheared through.

Figure 2:
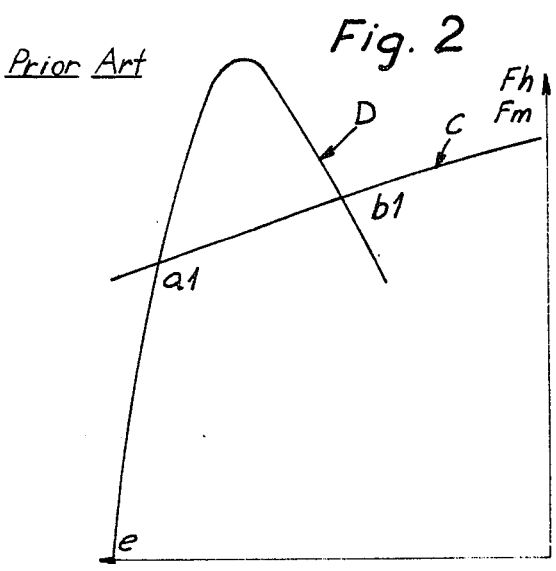
Prior Art Fig. 2

FIG. 2 shows a curve D representing a plot on the ordinate of the human force F*h* necessary to be exerted on the outer ends of the handles when a workpiece is held in the blades as the spacing *e* between these handles is descreased. Curve C indicates the force Fm which can be exerted comfortably on the handles with different spacings between these handles. This curve C is generally flat, but the curve D is downwardly concave and crosses the curve C at two points, $a_1$ and $b_1$, between which it is necessary for the user of the cutter to exert a very great force, far above that which can comfortably be exerted with the handle spacing in question. For this reason prior-art cutters are often mistreated, usually by using them to twist and wrench at the workpiece, whereas their sole function should simply be cutting straight through a workpiece.

Figure 3:
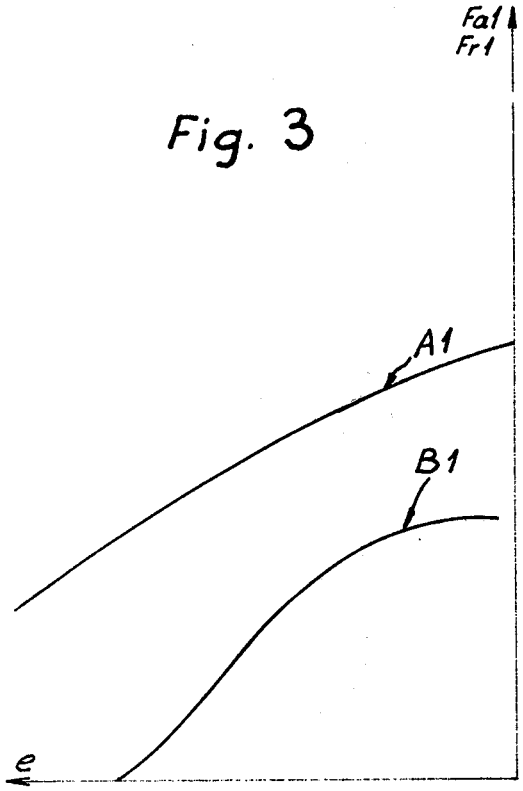
FIGS. 3 and 4 are graphs illustrating the kinematics of the system in accordance with this invention.
Figure 4:
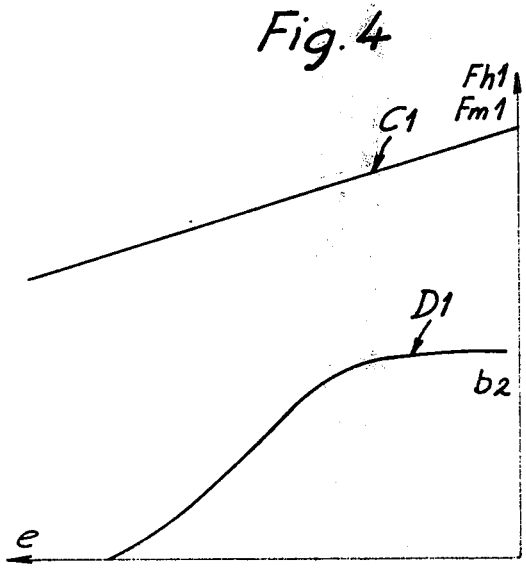
Figure 5:
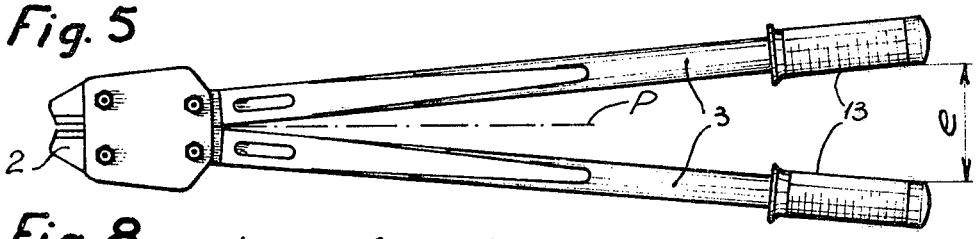
FIG. 5 is a side-elevational view of a bolt cutter according to the present invention.

The graphs of FIGS. 3 and 4 are plots similar to those of FIGS. 1 and 2, respectively, but illustrating the kinematic operational characteristics of the bolt cutter according to my present invention. Thus the curve $A_1$ of FIG. 3 illustrates how the cutting effort $Fa_1$ grows uniformly and progressively, so that this curve always lies above the curve $B_1$ illustrating the mechanical resistance $Fr_1$ of the workpiece. For this reason the curve $C_1$ of FIG. 4, identical with the curve C of FIG. 2 and indicating the human force $Fh_1$ comfortably exertable on the handles with a given spacings *e*, lies completely above the curve $D_1$ showing the actual force $Fm_1$ needed to cut through the workpiece. This curve $D_1$ terminates at a point $b_2$ corresponding to rupture of the workpiece prior to complete closing of the tool.

Figure 8:
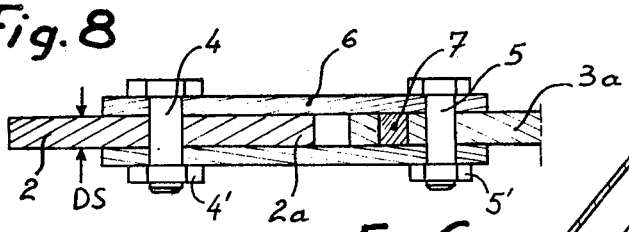
FIG. 8 is a section taken along line VIII—VIII of FIG. 7.

The cutter according to my invention, shown in FIGS. 5–8, has a pair of flat steel support plates 6 which are parallel and spaced apart by a distance DS (FIG. 8). A pair of elongated handles 3 of identical construction have outer ends carrying rubber handgrips 13 and have inner ends 3*a* of a thickness equal to D and projecting between the plates 2. A pair of rear axle pins 5 formed as screws with nuts 5' pass through these ends 3*a* and serve as pivots for the handles 3.

Figure 7:
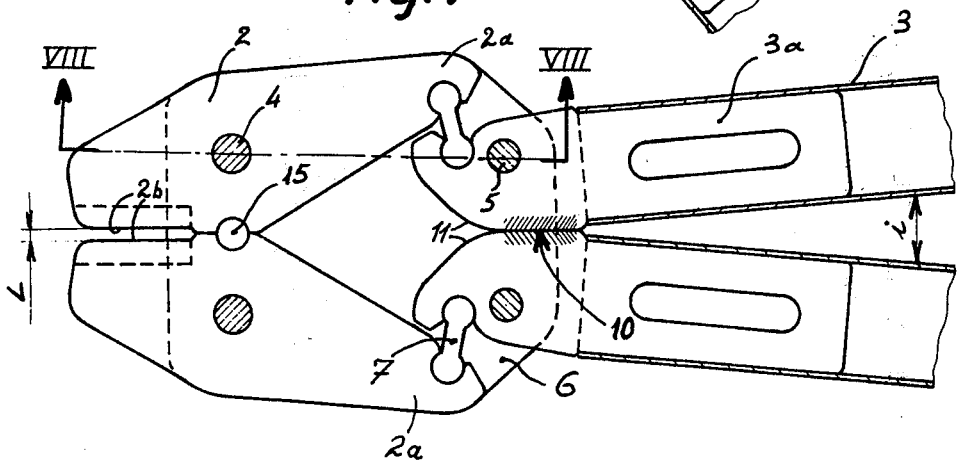

The two plates 6 are provided with a pair of parallel front axle pins 4 formed as screws with nuts 4' and serving to clamp the two plates together on opposite sides of the rear ends 2*a* of a pair of blade members 2 pivoted on these screws 4. These blades 2 have jaws with cutting edges 2*b* which are parallel and spaced apart by a distance L between 0.5mm and 2.0mm when the blades are closed as shown in FIG. 7. The rear or shanks 2*a* of these blades 2 are formed with part-cylindrical seats 8 open inwardly and across from corresponding outwardly open part-cylindrical seats 9 formed in the front extremities 3*a* of the handles 3. A short link 7, acting as a thrust member, has on its opposite ends cylindrical heads, 7*b* received in facing seats 8 and 9 to establish points of articulation between these members, blade shanks 2*a* and handle extremities 3*a*. Thus each link 7 connects a respective handle 3 to a respective blade 2. Screws or pins 4 and 5 are a pair of first and second fulcra, positioned on opposite sides of a centerline coinciding in FIG. 5 with a plane of symmetry P.

Figure 6:
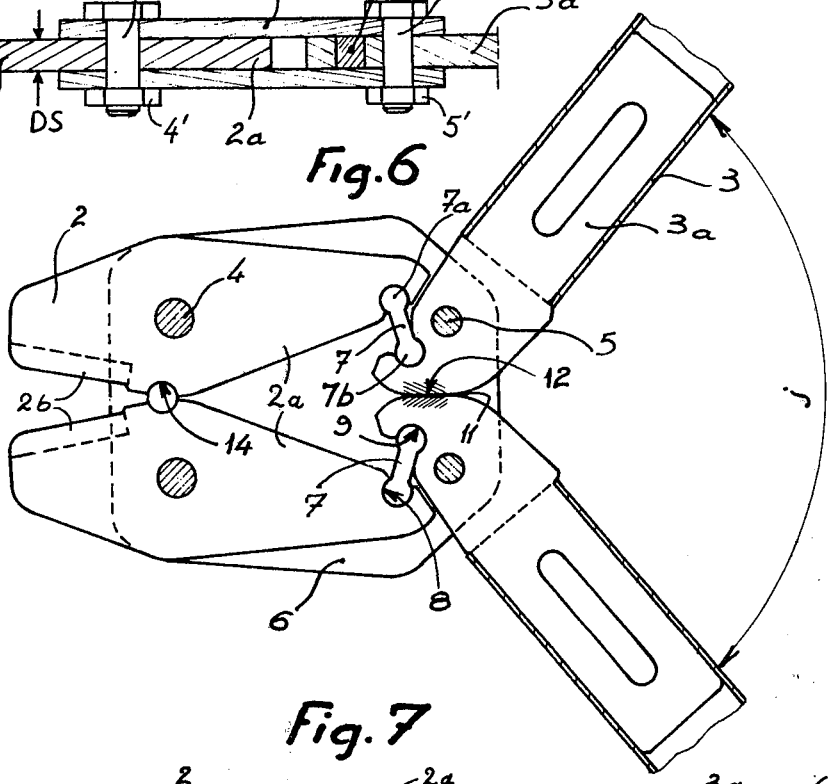
FIGS. 6 and 7 are large-scale longitudinal sectional views through the frontal part of the cutter of FIG. 5, in open and closed positions, respectively.

Furthermore each handle 3 is formed at its forward end or front extremity 3*a* with a front flat surface 12 adapted to flatly engage the corresponding surface 12 of the opposite handle so as to prevent spreading of the handles 3 by more than by an angle *j* shown in FIG. 6. Similar flat surfaces 10 are provided on these extremities 3*a* to prevent the handles from moving closer together than by an angle *i* shown in FIG. 7. Between its surfaces 10 and 12 each handle 3 is formed with a part-cylindrical surface 11 adapted to roll off the corresponding surface 11 of the other handle 3 as the handles 3 are moved and the spacing *e* between the grips 13 is changed. These surfaces 11 thereby prevent the axle pins 5 on which the handles 5 are mounted from being overloaded. The surfaces 10 and 12 are tangent to the respective surfaces 11.

Each blade 2 is formed with an inwardly opening part-cylindrical seat 14 directly between the pins 4 and across from the corresponding seat 14 of the other blade. A short cylindrical stud 15 of a length equal to DS is received in these complementary recesses 14 and ensures symmetry of movement between the two blades relative to the plane P.

All the flat elements, or parts of elements, between the two plates 6 are coplanar and of a thickness or height equal to DS so that the system can withstand considerable twisting. In addition the simple removal of the nuts 4' and 5' of the axle pins 4 and 5 allows one of the plates 6 to be withdrawn and any of the parts 2, 3 or 7 to be removed. Since both handles 3 are identical, along with both blades 2 and both links 7, the cutter can be produced very inexpensively. The links allow both the handles 3 and the blades 2 to be turned about relatively fixed pivot axes and, since these links 7 remain at generally the same angle nearly perpendicular to the plane P regardless of the positions of the handles 3 and blades 2, their force-transmission characteristics remain substantially uniform.

I claim:

1. A cutting tool comprising:

a flat support;

a pair of blades pivoted to said support by a first pair of fulcra on opposite sides of a centerline, said blades having coacting jaws forwardly of said first pair of fulcra and rearwardly extending shanks;

a pair of handles with front extremities bracketed by said shanks and pivoted to said support by a second pair of fulcra on opposite sides of said centerline rearwardly of said first pair of fulcra; and a pair of thrust members articulated to said shanks and to said front extremities at points forwardly of said second pair of fulcra, the points of articulation of each of said members lying on a line generally perpendicular to said centerline in both an open and a closed position of said jaws.

2. A tool as defined in claim 1 wherein said support comprises a pair of parallel plates bracketing said shanks, said front extremities and said thrust members, said plates being interconnected by two pairs of pins forming said first and second pairs of fulcra.

3. A tool as defined in claim 2 wherein said shanks, said front extremities and said thrust members are flat coplanar elements of a thickness substantially equaling the spacing of said plates, each of said thrust members terminating in a pair of cylindrically curved heads received in complementary seats of said front extremities and said shanks.

4. A tool as defined in claim 3 wherein said front extremities are provided with curved edge portions between said plates rolling on each other upon a movement of said handles between an open-jaw and a closed-jaw position.

5. A tool as defined in claim 3 wherein said blades have adjoining edges formed with complementary part-cylindrical recesses between said first pair of fulcra, further comprising a stud of a length equal to the spacing of said plates matingly received in said recesses.

* * * * *